US006598628B2

(12) United States Patent
Stocchi

(10) Patent No.: US 6,598,628 B2
(45) Date of Patent: Jul. 29, 2003

(54) FILLING VALVE OF BOTTLING PLANT

(75) Inventor: Gabriele Stocchi, Parma (IT)

(73) Assignee: STK Stocchi Progetti SRL, Parma (IT)

( * ) Notice: Subject to any disclaimer, the term of this patent is extended or adjusted under 35 U.S.C. 154(b) by 0 days.

(21) Appl. No.: 10/312,875

(22) PCT Filed: Jul. 5, 2001

(86) PCT No.: PCT/IB01/00970

§ 371 (c)(1),
(2), (4) Date: Jan. 2, 2003

(87) PCT Pub. No.: WO02/04340

PCT Pub. Date: Jan. 17, 2002

(65) Prior Publication Data

US 2003/0106606 A1 Jun. 12, 2003

(30) Foreign Application Priority Data

Jul. 7, 2000 (IT) ..... BO2000A0409

(51) Int. Cl.[7] ..... B65B 1/30

(52) U.S. Cl. ..... 141/198; 141/40; 141/214; 141/215; 141/301; 141/308

(58) Field of Search ..... 141/198, 214, 141/215, 57, 59, DIG. 2, 140, 95, 285, 289, 290, 301–310, 39, 40, 43, 44, 46

(56) References Cited

U.S. PATENT DOCUMENTS

| | | | | |
|---|---|---|---|---|
| 487,531 A | * | 12/1892 | Kiefer | 141/95 |
| 1,010,909 A | * | 12/1911 | Herd | 141/308 |
| 2,822,830 A | | 2/1958 | Grosbois | |
| 3,540,402 A | * | 11/1970 | Kocher | 141/198 |
| 3,605,827 A | * | 9/1971 | Risser | 141/198 |
| 4,787,428 A | * | 11/1988 | Bacroix et al. | 141/140 |
| 4,794,959 A | * | 1/1989 | Jordan et al. | 141/141 |
| 4,967,813 A | * | 11/1990 | Ponvianne et al. | 141/95 |
| 4,989,650 A | * | 2/1991 | Weiss | 141/40 |

FOREIGN PATENT DOCUMENTS

| | | |
|---|---|---|
| DE | 90 14 772 | 1/1991 |
| DE | 197 28 057 | 1/1999 |
| FR | 1 598 418 | 7/1970 |

* cited by examiner

*Primary Examiner*—Gregory Huson
*Assistant Examiner*—Khoa Huynh
(74) *Attorney, Agent, or Firm*—Oblon, Spivak, McClelland, Maier & Neustadt, P.C.

(57) ABSTRACT

Improvements to filling valves of bottling plants in which the interruption of the processing fluids' flow happens automatically when the level of the liquid inside the filled bottle reaches the lower edge of the vent tube and the air trapped in the filling valve prevents the coming out of the liquid from the tank even if the external membrane (6) is still in the open position.

2 Claims, 2 Drawing Sheets

FILLING VALVE OF BOTTLING PLANT

FIELD OF THE ART

The present invention is related to the technologies of the bottling processes, and it specifically pertains to improved filling valves of turret filling machines. Such technologies are included in the International Classification B67c.

STATE OF THE ART

In the previous technology are known several kinds of filling valves that are set up peripherally around filling turrets.

All kinds of known filling valves have intercepting organs inside the bodies of the filling valve that constitute an obstacle for the flow of the filling fluid and for the cleansing operations. In fact, said intercepting organs inside the downflow conduits create retention zones or interstices, where the residual particles of the processing fluid often are gathered.

The problem to be solved is to eliminate such intercepting organs inside the filling valve in order to eliminate all the related problems of the traditional filling valves.

DESCRIPTION

The invention is now disclosed with reference to the schematic figures of the attached drawings as a not limiting example.

Figure 1:
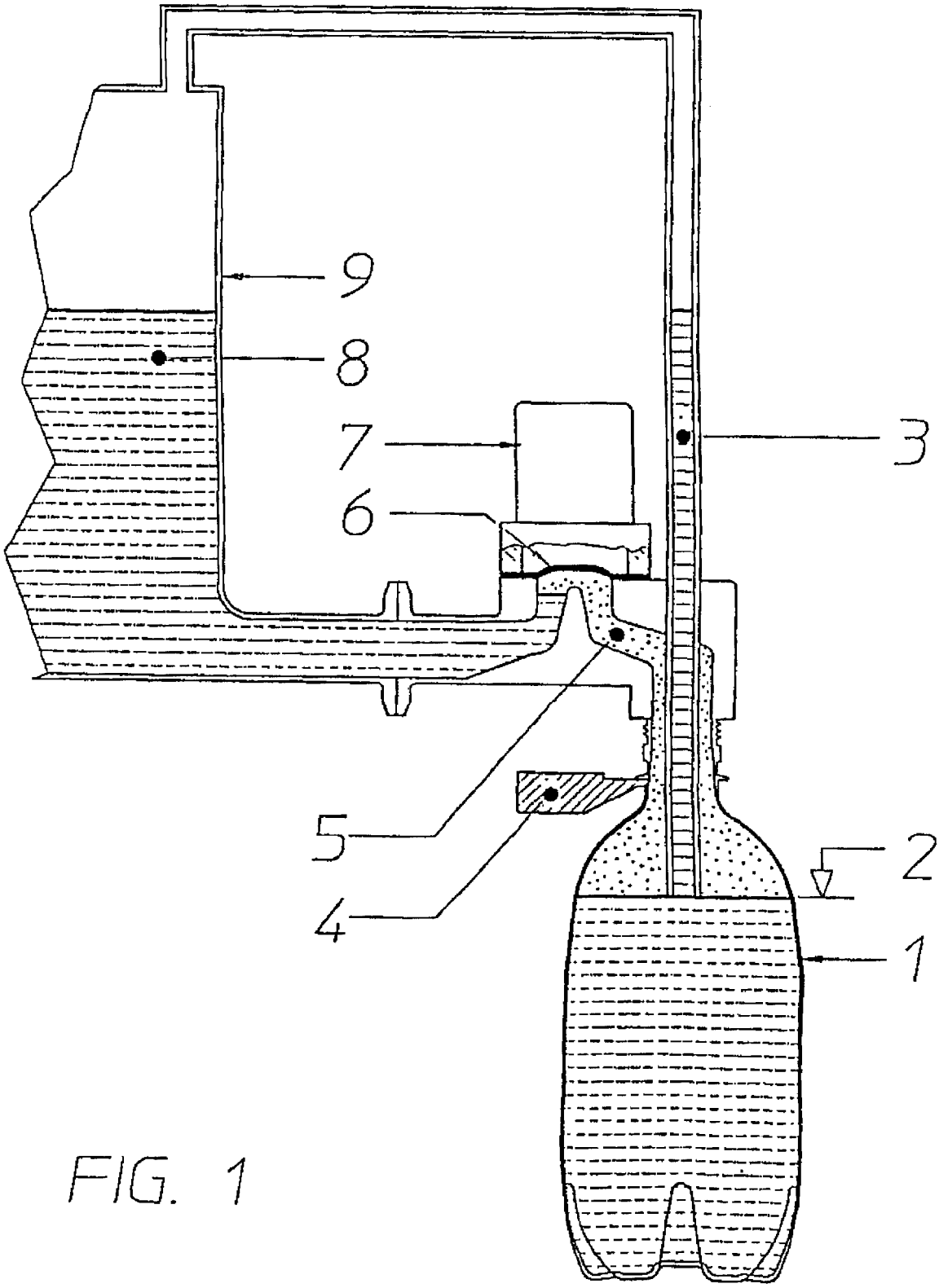

FIG. 1 represents schematically a filling valve at the end of filling phase of a bottle. One can notice that the filling valve does not have intercepting organs inside of the downflow conduits. Nonetheless, the downflow of the liquid is stopped by the air trapped inside the filling valve. This phenomenon allows the optimization of the shape of the downflow conduits, thus solving all the problems of the traditional filling valves. The filling valves made according the improvements object of the present invention will be cheaper in the realization and more reliable during the filling and cleansing operations.

Figure 2:
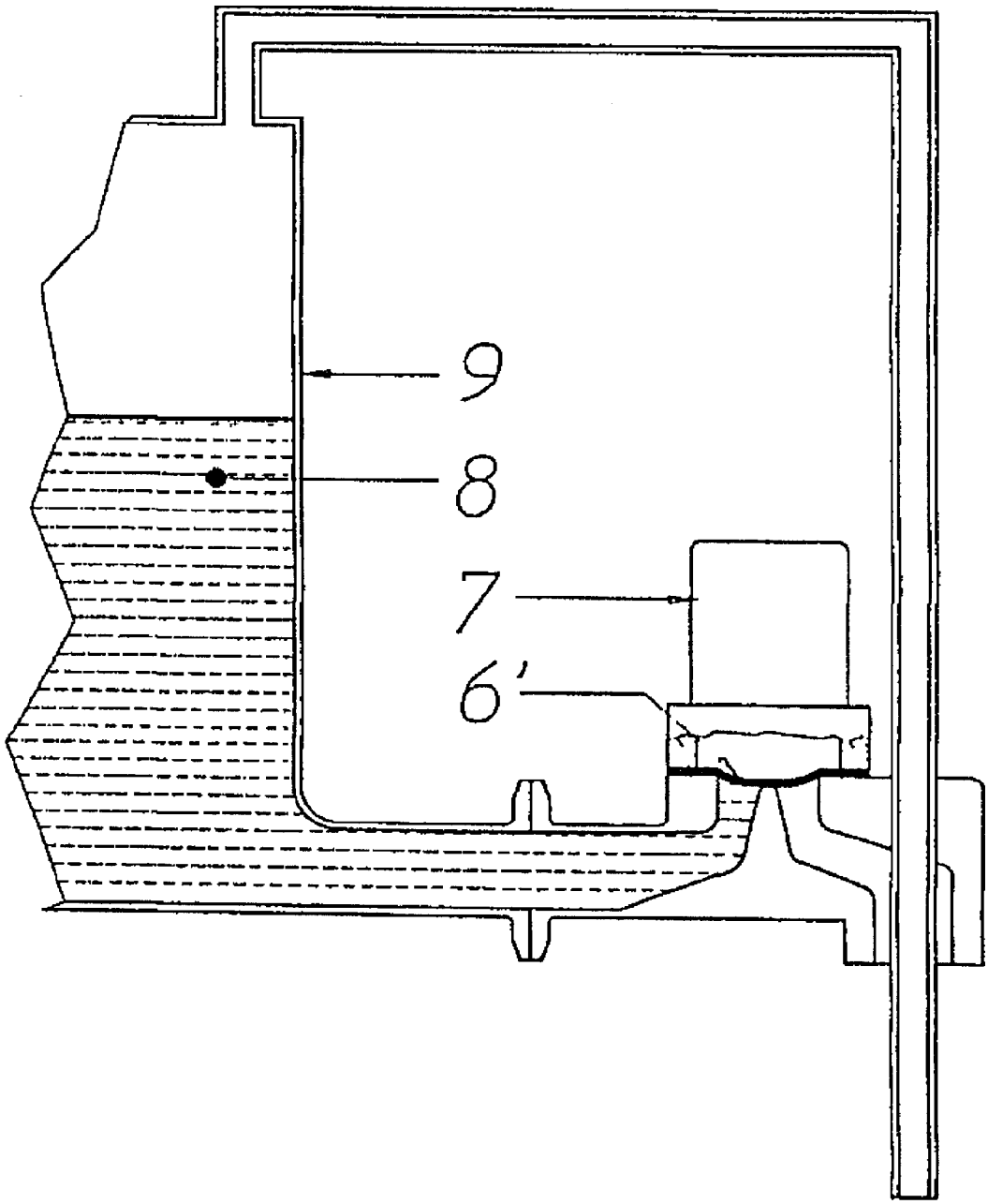

FIG. 2 represents schematically a filling valve during the removal phase of the filled bottle. One can notice that, during this phase, the filling valve without inner intercepting organs is closed by a membrane 6' external to the enbloc body of the filling valve, said membrane is deformed by an external synchronized electrovalve 7.

One can notice that there are not intercepting and sealing organs inside the filling valve and that said membrane 6', hermetically sealed, is constantly held upon the enbloc body of the filling valve and that it keeps closed from the outside the downflow conduit.

In the figures of the attached drawings, each single detail is marked as follows:

1 is the filled bottle

2 indicates the lower edge of the venting tube that sets the filling level of the liquid in the bottle

3 is the air venting tube inside the empty bottle

4 bottle's handling device

5 is the zone where the air is trapped when the liquid's level reaches the lower edge of the venting tube

6 is the external membrane in opening position

6' is the external membrane in closing position

7 is the external synchronized electro-valve

8 is the liquid phase of the bottling process

9 is the general tank of the liquid

The evidence of the figures highlights the operation of the filling valve is extremely simple and automatic. In fact, even though the filling valve does not internal intercepting organs, the stopping of the filling process happens by siphon effect. It is the residual air that being trapped inside the flowing conduits interrupts the downflow of the liquid when inside the bottle is reached the level set by the position of the lower edge of the venting tube. The absence of intercepting organs inside the filling valve allows to realize flowing conduits with optimized profile, that is without retention zones and interstices that disturb the laminar motion of the filling and don't obstruct the cleansing operation.

The invention of course allows for several variations of practical realization as far as the proportional structuring and the technological choice are concerned, that will adjusted to the different needs of bottling plants. It is therefore evident that all improvements to filling valves that will be based on the inventive principles of the present invention, as substantially described, illustrated and hereinafter claimed, will be considered part of the protection sphere of the present invention.

What is claimed is:

1. Valve of bottling plants with automatic happening of an interception of a downflow of process fluids when a level of a liquid inside a filled bottle reaches a lower edge of a venting tube and preventing by air trapped inside the filling valve the liquid from coming out from the tank even if a closure element is still in an opening position, wherein the closure element of the valve is an elastic membrane, arranged external to a filling headbody and actuated by a synchronised electro-valve.

2. Valve according to claim 1, wherein the valve is connected to a downflow conduit without internal organs of the interception, retention zones, and interstices.

* * * * *

UNITED STATES PATENT AND TRADEMARK OFFICE

CERTIFICATE OF CORRECTION

PATENT NO. : 6,598,628 B2
DATED : July 29, 2003
INVENTOR(S) : Stocchi

It is certified that error appears in the above-identified patent and that said Letters Patent is hereby corrected as shown below:

Title page,
Item [22], PCT Filing Date, should read:
-- [22] PCT Filed: Jun. 5, 2001 --

Signed and Sealed this

Twentieth Day of April, 2004

JON W. DUDAS
*Acting Director of the United States Patent and Trademark Office*